US006124575A

United States Patent [19]

Black

[11] Patent Number: 6,124,575

[45] Date of Patent: Sep. 26, 2000

[54] LOW TEMPERATURE LOW VOLTAGE HEATING DEVICE

[76] Inventor: Ernest C. Black, 200 Country Club Place, Sault Ste. Marie, Ontario, Canada, P6A 6A3

[21] Appl. No.: 09/268,327

[22] Filed: Mar. 16, 1999

[51] Int. Cl.[7] ..... H05B 3/68; H05B 3/08

[52] U.S. Cl. ..... 219/465.1; 219/541

[58] Field of Search ..... 219/465.1, 466.1, 219/467.1, 443.1, 450.1, 538, 541, 542; 338/280, 281, 283, 284; 118/725, 726

[56] References Cited

U.S. PATENT DOCUMENTS

| | | | |
|---|---|---|---|
| 1,143,575 | 6/1915 | Denhard | 338/283 |
| 1,829,553 | 10/1931 | Andre | 338/293 |
| 2,640,861 | 6/1953 | Kremers | 117/223 |
| 3,381,114 | 4/1968 | Nakanuma | 118/725 |
| 3,453,585 | 7/1969 | Croft et al. | 338/284 |
| 3,496,336 | 2/1970 | Hingorany et al. | 219/446.1 |
| 5,218,334 | 6/1993 | Bartlett | 338/206 |
| 5,344,492 | 9/1994 | Sato et al. | 118/725 |

*Primary Examiner*—Sam Paik
*Attorney, Agent, or Firm*—David J. French

[57] ABSTRACT

A low voltage heating element is formed from a flat plate of partially conductive material, such as a graphite/polymeric composite. Food may be cooked thereon at power consumption levels of below 150 watts, thereby enabling use of batteries or solar cells as the energy source.

10 Claims, 5 Drawing Sheets

LOW TEMPERATURE LOW VOLTAGE HEATING DEVICE

FIELD OF THE INVENTION

This invention relates to an electrical heating element. In particular, it relates to an electrical heating element that operates from a low voltage source, achieves only moderately elevated temperatures, and is suited for the cooking of food.

BACKGROUND TO THE INVENTION

In the cooking of food and preparation of hot beverages, it is possible to produce satisfactory results for many dishes without ever raising the internal temperature of the food or beverage above the range of 75–85° C. If this upper limit is accepted, it becomes practical to consider heating food or beverages in quantities of ¼ to 1 liter using relatively low power electrical energy: vis 40 to 100 Watts. With these limiting conditions, it is feasible to use batteries and solar panels as the electrical energy source.

Most, if not all, consumer product heater elements are fabricated from a conductor, usually thermal wire or possibly carbon, embedded in an insulating material, usually a ceramic. Most heating elements paths are in the form of a strip, multi-ring spiral, or multi-leg parallels. They are generally highly rigid and are supported at specific locations on metal posts. There is not generally available on the market a heater element composed of a uniform partially conducting material that is supported over the greater part of its underside surface.

To make most efficient use of electrical energy from low power sources, it is important to design the electrical heating element in a form that is low cost, robust, and energy efficient. This invention addresses these objectives.

Amongst the main challenges of the invention are to:

- configure a device that operates at a low enough temperature to not damage the element or base materials;
- avoid the development of "hot spots" on the surface of the element;
- effect a low resistance electrical contact to the preferred element material that will permit high currents to be employed.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this specification.

SUMMARY OF THE INVENTION

The present invention, according to one aspect, provides an electrical heating device comprising a generally planar heating element in the form of a plate of partially conductive material having a flat upper surface and a lower, underside surface with a continuous current path defined through said conductive material wherein the current path has peripheral and central portions.

An electrically insulating base provides support for the said element, the insulating base providing distributed support for the conductive material, preferably evenly and over the greater portion of the surface of the lower side surface of the heating element. This result can advantageously be achieved by forming the element from a partially conductive material, such as a graphite composite, in the general form of a plate and defining the current path by providing narrow gaps in the plate.

Thus, in a preferred embodiment, the continuous current path in the plate is provided by utilizing a plate in the form of a sheet into which a current path defining gap (or gaps) is/are provided, the gap or gaps each having a terminus within the plate area. Such gaps should be narrow to maximize the heat dissipation area of the planar heating element for efficient heat transfer during cooking and to limit temperature rise during stagnation conditions when no cooking container is present. These gaps should also be configured to minimize variations in temperature along the current path. The heating element of the invention has a continuous inner and outer current path interrupted at a convenient point to provide for two electrical connections. This configuration is believed to be the best compromise in order to:

- allow a relatively uniform current density and resulting uniform heat dissipation,
- allow an available resistivity for the material and applications intended,
- maximize the surface area and thereby to minimize the operating temperature over the surface area,
- provide adequate structural rigidity to provide a robust element,
- allow the interruption of the path for the electrical connection to be done at any convenient point in the path.

According to another aspect of the invention the heating element and base may be secured together by a connection means, which may serve as one of the electrical connection points, that permits the element to expand thermally about a single location on the element.

When a conductor path bends around the terminus of a gap, the current will tend to concentrate toward the shorter path on the inside of the bend. Where the resistivity, thickness and width of the current path remain constant, the power density due to resistive losses across the conductor path will vary directly with the square of the current. Thus "hot spots" or regions of higher temperature will normally be formed around the inside portions of bends in the current path.

By enlarging the terminus ends of gaps and by using an enlarged radius of curvature rather than sharp corners in establishing curved portions of the path of the gaps through the plate, the course of the current path on the inside of the bend can be adjusted and temperature variations may be reduced.

The thickness or width of the element can also be increased on the outside portions of the current path around bends, decreasing the local, overall resistance and reducing the current density passing through such regions. This provides a further means to control temperature variations.

When a right bend is formed, as around the central gap that terminates at the centre of the element, a copper connection means at this central point will also reduce the current density in the adjacent element material.

Conductive material can be embedded in the element or a conductive material can be coated on the surface of the element as a further means to reduce the current density in hot spots of the element.

The path width can further be increased as an additional means to reduce the current density levels and redistribute the heat dissipation area. As the inner portion of the plate will tend to heat to a higher temperature under stagnation conditions than the outer portion when generally constant current density levels are present (due to radiation losses), a more even heating effect can be achieved by reducing the current in the inner, central, portion of the element. This can be accomplished by locating the gaps surrounding the central shaped portion at positions which provide for a greater average width in the current path within the inner portion than within the outer portion. This differential-heating provision is particularly useful to limit localized overheating of the element and base, particularly when the element is provided with current in the absence of a heat-absorbing container.

By all of the foregoing means, the presence of "hot spots" can be controlled and temperature variations can be limited.

The current path may be designed to form a continuous loop that can be interrupted at any convenient location to position two adjacent terminals at the ends of the current path. By providing two proximate electrical connectors at the connection ends of the current path, a single wire pair connected to an electrical source can be directly and conveniently attached to these respective coupling ends. This will provide a single series current path through the element. Alternately, one wire from such a wire pair can be connected to both the first and second electrical coupling ends and the other wire from the wire pair can be connected to the plate, near the central point of the current path. This will effect a "parallel" format connection.

As the heating element has a planar or flat upper surface, it is important that the flatness of this thermal-transfer zone not be interrupted by protrusions. It is, therefore, highly desirable that any electrical connectors passing through the plate be embedded or connected within countersunk depressions formed within the upper surface of the plate to preserve flatness.

At the electrical current levels contemplated for the invention it is important that the electrical connection between the wires providing current and the heating element be of minimal resistance. With a plate of graphite composite as the heating element, it has been found that a compressive connection is preferable, and may in cases be essential. It has also been found that copper provides a lower connection loss than aluminum particularly at a graphite-based interface. This may be due to the fact that copper oxide is more conductive than aluminum oxide.

By choosing a container for placing over the upper flat surface of the element that has a flat bottom and spans the full width of the element, a high efficiency in the transfer of heat into the container can be achieved. To avoid shorting the electrical heating element, the container may have an electrically insulative, thermally conductive coating on its bottom surface, e.g. enamel; or the element may have an electrically insulative, but thermally conductive, coating on its upper surface to permit use of metal-bottomed cookware. A further alternative to avoid shorting is to provide a heat conducting, insulative spacer, such as a sheet of mica or equivalent material, between electrically conductive cookware and the element.

By providing a moderate level of applied voltage and current flow, for example, 12 volts and 5 amps, an electrically safe, heated surface with minimal local temperature variations can be so formed. Preferably, for safety purposes the voltage source may be limited to not greater than 30 volts and the power consumption of the element may be limited not to exceed 150 watts.

The heating element, when constrained to operate at below about 160° C., whether by its geometric configuration or by limiting the applied voltage, can be mounted on a wooden, wood-composite or suitable polymeric plastic or ceramic base. This allows for the provision of a low cost, durable, heating system readily suited for cooking and warming food and liquid containers.

For example, operating at 12 volts (AC or DC) and 5 amps the heater of the invention, radiating energy at a rate of 4 watts per square inch, will cook ½ cup of brown rice in 1 cup of water in about 40 minutes. Similarly, by utilizing the 12 volt source of a car battery, a container of coffee can be heated or be kept warm within an automobile indefinitely.

The foregoing summarizes the principal features of the invention and some of its optional aspects. The invention may be further understood by the description of the preferred embodiments, in conjunction with the drawings, which now follow.

BRIEF DESCRIPTION OF FIGURES

The present invention will be further understood from the following description with reference to the drawings in which.

DETAILED DESCRIPTION OF FIGURES

Figure 1:
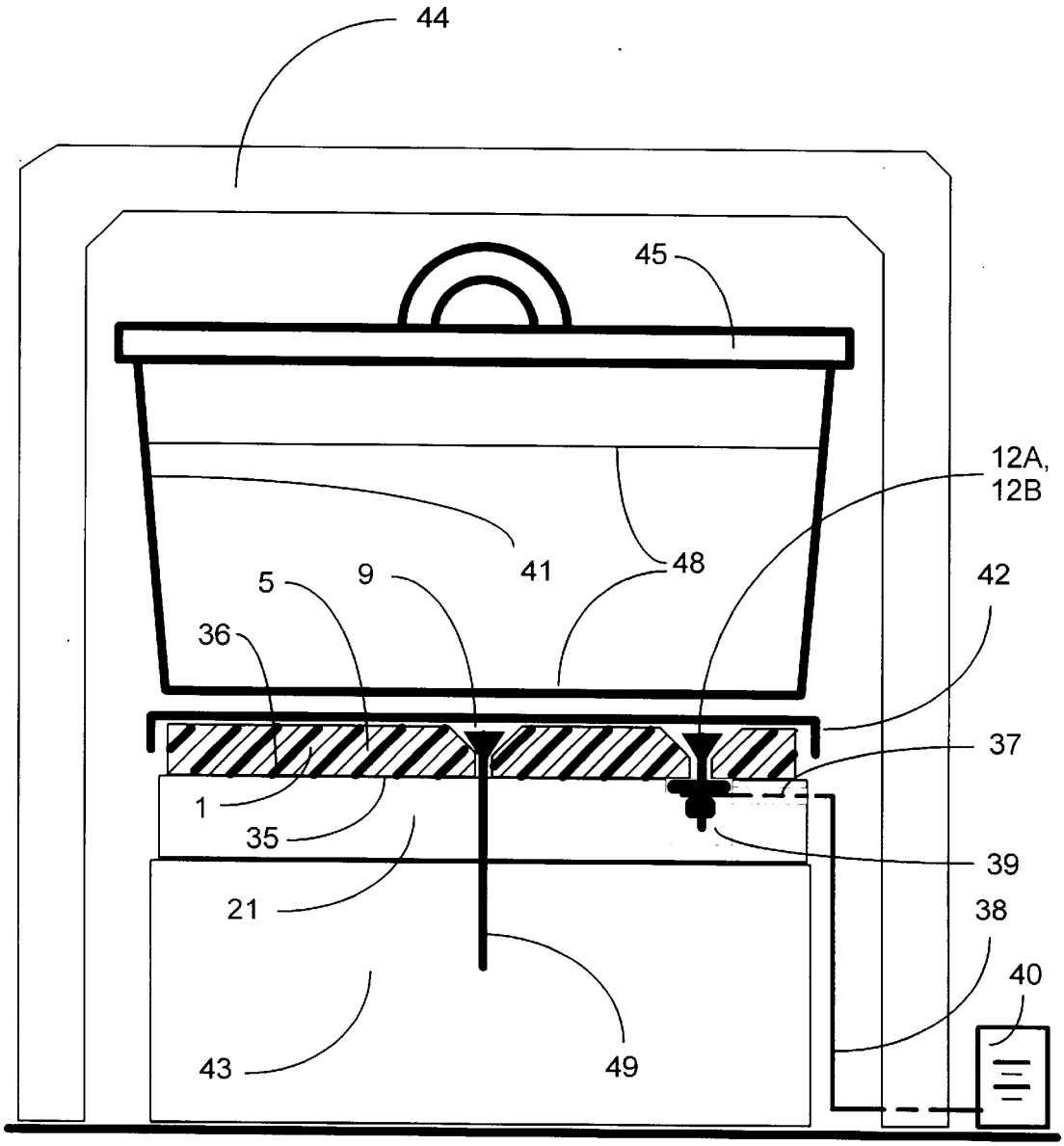
FIG. 1 illustrates a side cross-sectional view of a heating element of the present invention seated on a supporting base and carrying a cooking vessel.

Referring to FIG. 1, a heating element assembly 5 is shown, based on a plate 1 made of a sheet of partially conductive material. The plate 1 is mounted above the top surface 35 of a base 21. Because the plate 1 is thin and planar, it is not structurally strong and would be susceptible to breakage if provided with a single or only a few point supports.

To prevent its deflection, the plate 1 is provided with distributed support over its underside surface by the base 21. Preferably the plate 1 is supported by the top surface 35 of the base 21 over the greater portion of the surface area of the lower side 36 of the plate 1, i.e., over 50% or more of its lower surface area.

The base 21 may preferably be made of an electrically insulative, high temperature material, such as silicone, which will insulate any lower support or sub-base 43 from the temperature of the plate 1, thereby allowing a greater choice of materials for the sub-base 43.

The base 21 may also provide a recess 39 to receive the electrical connections to the plate 1. As shown in FIG. 1 a channel 37 allows wires 38 to access the connection point holes 12A, 12B on the plate 1 through the recess 39.

Figure 3:
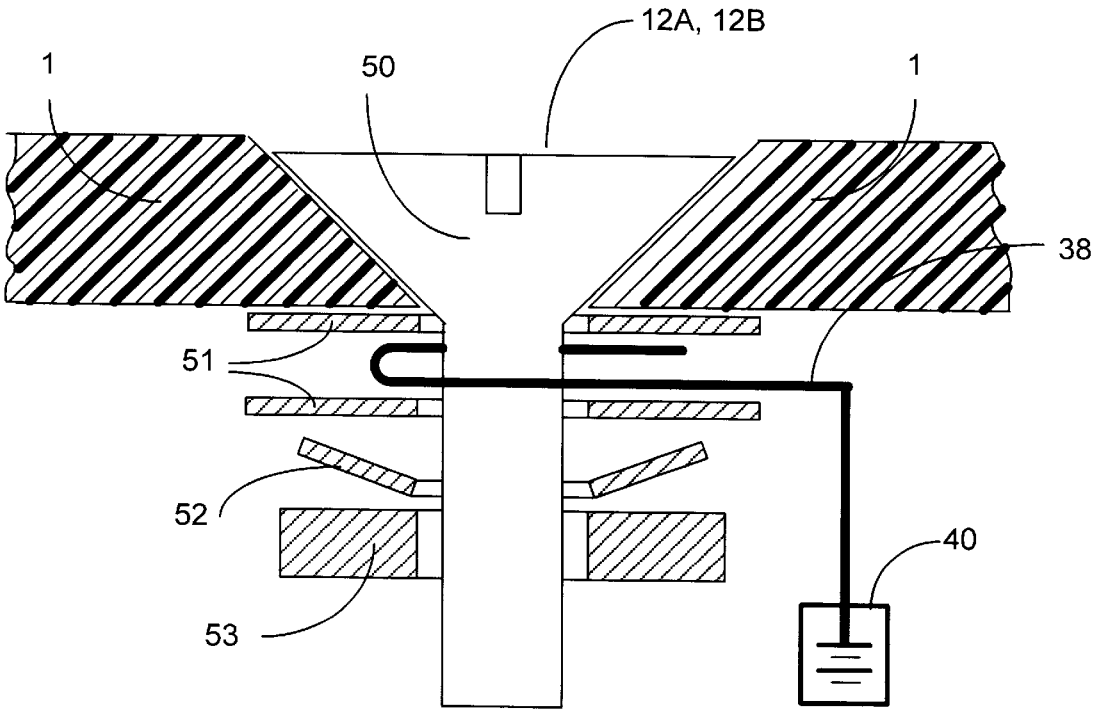
FIG. 3 is a cross-sectional view of an electrical connection formed between a wire and the heating element.

As shown in FIG. 3, conductive threaded connectors 50, preferably flat-headed, copper bolts (or bolts having a copper seating surface), pass through the countersunk connection point holes 12A,12B in the plate 1 into the recess 39 in the base 21. At the threaded lower ends of the bolts 50, nuts 53, washers 51 and spring-loaded lock washers 52 connect the wires 38 in place. A low voltage power source, e.g. a 12 or 24 volt battery 40 provides current to the wires 38.

A cooking container 41 containing a liquid 48 is placed over the heating element 5, preferably covering virtually all of its upper surface to maximize heat transfer efficiency. In cases where the container 41 is electrically conductive, a thin, thermally conductive, electrically insulative sheet 42, e.g. of mica, is placed between the food container 41 and the heating element 1. A lid 45 is preferably employed on the container 41. A further insulating shroud 44 may cover the entire unit to further increase heating efficiency.

Figure 2:
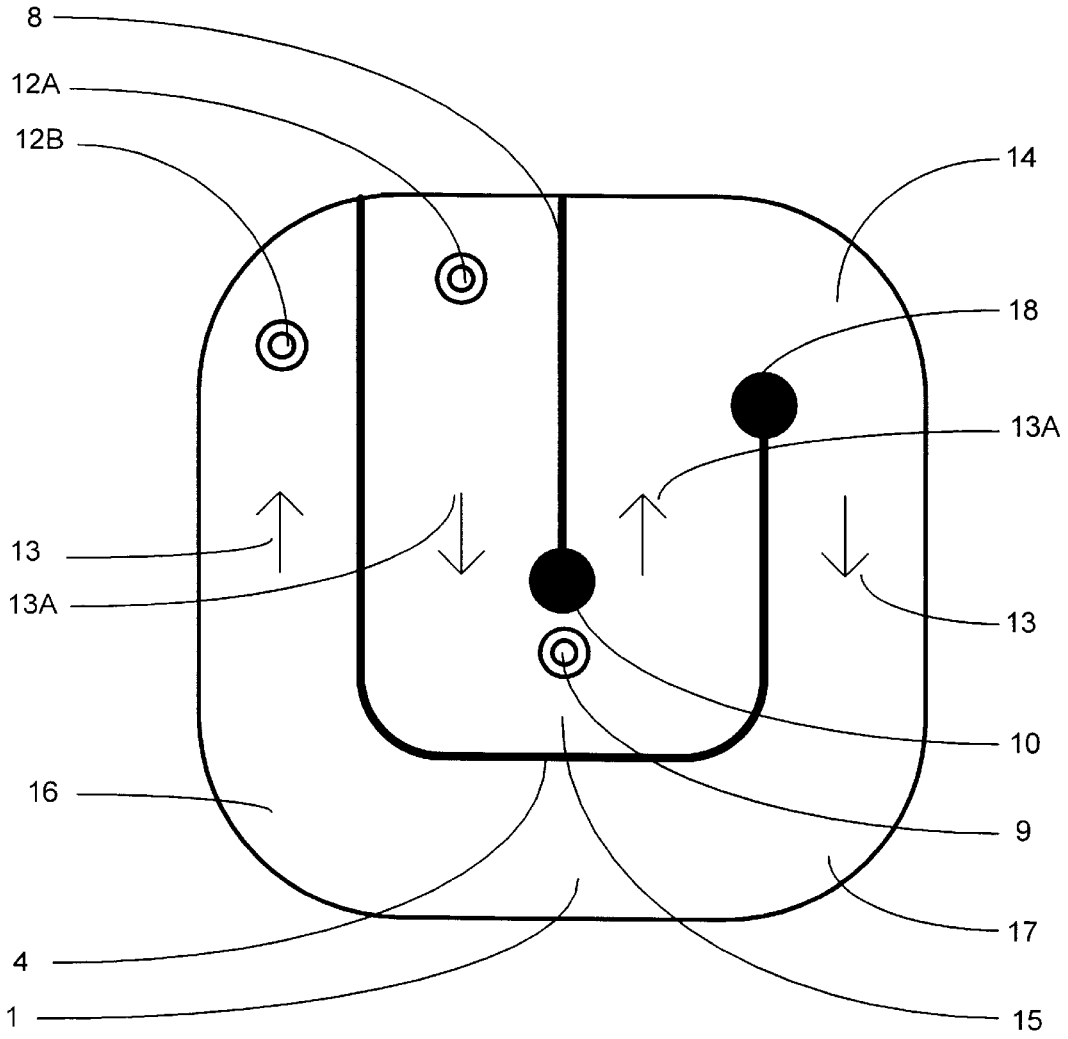
FIG. 2 illustrates a top view of a heating element of the present invention having a first form of current path.

The heating element plate 1 of the invention as shown in FIG. 2 may be in the general shape of a square which has optionally had its four corners removed to save material and to more conform to a circular heating element. The plate 1 has a continuous current path 13 and 13A by virtue of gaps 4, 8 cut into the sheet of partially conductive material.

The upper gap 8 is shown cut from the top side of the square terminating approximately in the centre 10 of the square and in the middle of the "U"-shaped interior gap portion 4.

The width of any portion of the current path 13,13A in the partially conductive material of the plate 1 is intended to be largely similar but adjusted so as to minimize excessive variation in the power dissipated within the path 13, 13A. Thus, excessively heated regions of elevated temperature—"hot spots"—are to be avoided.

A generally centrally located countersunk hole 9 is provided for mounting the plate 1 to the base 21. A fastener 49 shown in FIG. 1, such as a flat-top wood screw may pass through the hole 9 to effect connection between the base 21, and plate 1. By fixing the plate 1 to the base 21 at a single point the plate may expand thermally about the location of the generally centrally placed hole 9.

In FIG. 2 two electrical connection points 12A, 12B are provided in the partially conductive material in the form of countersunk holes. These holes 12A, 12B are shown centrally positioned within the width of the current path portions 13, 13A to provide a series-format current path 13,13A from point 12A to point 12B.

The gaps 4, 8 provide a continuous current path 13,13A between connector points 12A and 12B. When the thickness of the plate 1 is constant, the width of any portion of the path 13,13A in the partially conductive material may be approximately constant to provide a generally constant current density along the current path 13, 13A. Preferably, to avoid hot spots, the current density should not exceed a range of ±30%, more preferably ±20% about the average current density. As the central portion of the plate 1 will experience less radiative heat loss than the periphery, the current density in the inner portion 13A of the current path 13, 13A, may be intentionally reduced by widening the inner portion 13A of the path 13, 13A. This is shown in FIG. 2 wherein the width of inner current path 13A is slightly more than the width of outer current path 13.

The element and base will have a limiting, upper operating temperature beyond which non-reversible damage will occur to the plate 1 or base 21. This may arise when the plate 1 is left uncovered and air cooled. For example, users may decide to employ the heating element assembly 5 for small space heating, or a cooking container may be left off an energized element assembly 5 by oversight. The temperature rise thereby occurring should be limited under such "stagnation" conditions by appropriate design features such as the selection of the resistivity of the material, and the applied voltage.

Besides maximizing the heat dissipation area, several means may be used to avoid current concentration and thereby hot spots in the element, so that maximum advantage can be made of the heating area and element material. These include:

A. The inner conducing path 13A cross-section may be of enlarged width to maximize the heat dissipation area, and avoid heat concentration in the center.

B. The terminal ends of the gaps 4,8 may be enlarged by circular relief holes 18 to reduce current concentration as the current passes around the ends of the gaps 4, 8.

C. The gaps 4, 8 are preferably made as narrow as reasonably possible to increase heat dissipation area.

D. To reduce localized heating within the element 5, the plate 1 may be thickened or widened in certain areas of current concentration, such as at the ends 10, 18 of gaps 4, 8 and at bends 16, 17.

Figure 4:
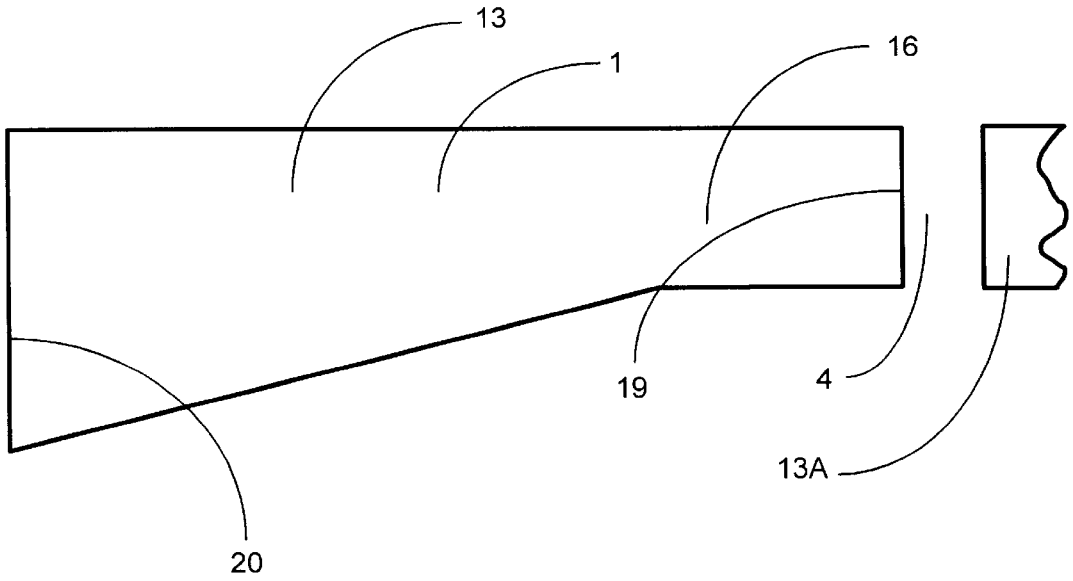
FIG. 4 is a cross-sectional view through the current path of the element of FIG. 2 showing variations in the shape of the underside surface of the heating element that provided thinner regions in the current path.

FIG. 4 shows a cross-section of the current path 13 for the modified bend areas 16 shown on FIG. 2. The thickness of the plate 1 is normally uniform. To reduce hot spots the bend area 16 may be provided with an increased outside thickness on the outside 20 of a bend in the current path 13. The extent of the change in the thickness of the plate 1 can be optimized for various configurations and applications.

Conductive material 19 can be embedded in the element or can be coated on the surface of the element to reduce the current density in hot spots of the element whose temperatures are not limited by other means.

Figure 5:
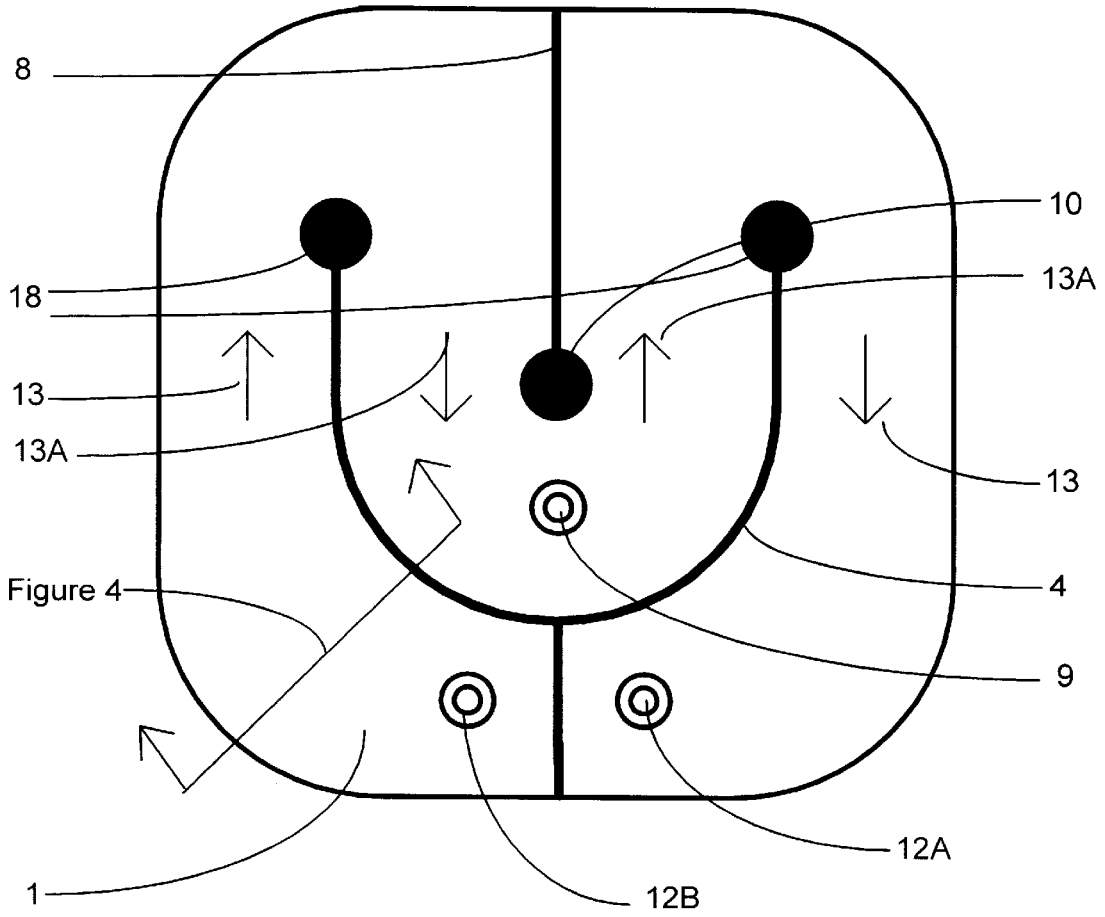
FIG. 5 illustrates a top view of the heating element with an alternate format of current path to FIG. 2.

FIG. 5 shows an alternate, less desirable configuration of the plate 1 from that of FIG. 2. FIG. 5 shows symmetrical current paths with inner 13A and outer 13 portions. By using the central mounting hole 9 to provide an electrical connection receiving current from connections 12A, 12B, FIG. 5 can be operated as a parallel circuit.

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. An electrical heating device comprising a heating element made of a partially conductive material, in the form of a plate having an upper surface, a lower, underside surface with a continuous current path defined through said conductive material wherein the current path is defined by one or more gaps present in the plate of partially conducting material, said one or more gaps having terminal ends within the plate and wherein the width of the gaps at their terminal ends within the plate is enlarged by provision of openings at such ends to reduce the tendency for a high current density to develop around such terminal ends.

2. An electrical heating device as in claim 1 wherein the heating element and base are secured together by a connection means that permits the element to expand thermally about a single location on the element.

3. A heating element as in claim 1 wherein the current path of the element is of increased thickness or width in one or more specific local areas to decrease the resistance and reduce local power densities within those portions of the current path.

4. A heating element as in claim 1 in combination with an electrically and thermally non-conductive base having an upper support surface positioned to effect distributed contact with said heating element over the under side of the heating element, said plate being carried by and supported on its underside surface by the upper support surface of the base to limit deflection of the plate upon application of a load on the upper surface of the plate.

5. An electrical heating device as in claim 4 wherein said support occurs over the greater portion of the surface area of said underside surface of the plate.

6. An electrical heating device as defined in claim 1, wherein the upper surface of said heating element is provided with an electrically insulative, thermally conductive layer.

7. An electrical heating device according to claim 1, wherein said partially conducting material has an electrical resistivity, said resistivity and the dimensions of the current path being such that, when current flows along the current path, current density measured transversely within the current path does not vary by more than 30% from the average current density along said path.

8. An electrical heating device as in claim 1 in combination with a voltage source of less than 30 volts, said combination being capable of providing no more than 150 watts of power.

9. An electrical heating device as in claim 1 wherein the current path has peripheral portions with outer edges and central portions.

10. A heating element as in claim 9 wherein the width of the peripheral portion of the current path lying along the outer edges of the element is less than the width of the current path in the central portion of the current path.

* * * * *